US005360125A

United States Patent [19]

Dawson et al.

[11] Patent Number: 5,360,125

[45] Date of Patent: Nov. 1, 1994

[54] DRAW BAR CONNECTION HAVING A RELATIVELY RIGID FILLING MEMBER TO ALLOW ABOUT ONE HALF INCH OF TRAVEL

[75] Inventors: Richard W. Dawson; Ronald P. Sellberg, both of Naperville; Richard P. Yeates, Aurora, all of Ill.

[73] Assignee: TTX Company, Chicago, Ill.

[21] Appl. No.: 99,777

[22] Filed: Jul. 30, 1993

Related U.S. Application Data

[63] Continuation of Ser. No. 913,000, Jul. 14, 1992, abandoned.

[51] Int. Cl.[5] ..... B61G 9/00

[52] U.S. Cl. ..... 213/62 R; 213/50; 213/75 R

[58] Field of Search ..... 213/50, 59, 61, 62 R, 213/62 A, 64, 69, 72, 75 R

[56] References Cited

U.S. PATENT DOCUMENTS

| | | | |
|---|---|---|---|
| 2,318,472 | 5/1943 | Dwyer, Jr. et al. | 213/59 X |
| 4,258,628 | 3/1981 | Altherr | 213/75 R |
| 4,531,648 | 7/1985 | Paton | 213/50 |
| 4,545,304 | 10/1985 | Brodeur et al. | 213/62 R X |
| 4,681,040 | 7/1987 | Brodeur et al. | 213/62 R X |
| 5,131,548 | 7/1992 | Chi | 213/64 |

FOREIGN PATENT DOCUMENTS

| | | | |
|---|---|---|---|
| 1258258 | 8/1989 | Canada | 213/61 |

*Primary Examiner*—Robert J. Oberleitner
*Assistant Examiner*—S. Joseph Morano
*Attorney, Agent, or Firm*—Dorn, McEachran, Jambor & Keating

[57] ABSTRACT

An improved drawbar connection for railroad cars reduces slack between cars and results in improved train handling. The drawbar connection fits in a standard draft gear pocket and utilizes a standard yoke, standard follower and standard coupler pin, thereby permitting the application of drawbars with minimal structural modification to cars originally equipped with conventional couplers. The usual draft gear is replaced by a filler which is relatively rigid. The filler includes a follower block, a wedge, a filler block and may include a mini-draft gear having a maximum travel of about one-half inch.

11 Claims, 3 Drawing Sheets

DRAW BAR CONNECTION HAVING A RELATIVELY RIGID FILLING MEMBER TO ALLOW ABOUT ONE HALF INCH OF TRAVEL

This is a continuation of copending application(s) Ser. No. 07/913,000 filed on Jul. 14, 1992 now abandoned.

SUMMARY OF THE INVENTION

This invention concerns an improved drawbar connection for railroad cars. The drawbar connection reduces slack between cars and thereby improves train handling and reduces damage to lading.

A primary object of the invention is a drawbar connection which can be utilized on cars having a standard draft gear pocket. This permits cars originally equipped with conventional couplers and draft gears to be connected by drawbars without having to make extensive modifications to the car structure. Similarly, carbodies originally connected by drawbars can be readily divided into separate cars and equipped with individual couplers and draft gears.

Another object of the invention is a drawbar connection which reduces slack between connected railroad cars.

A further object of the invention is a drawbar connection which utilizes several conventional components, including the draft gear follower, coupler pin and yoke.

A further object of the invention is a drawbar connection which accommodates vertical angling of the drawbar.

These and other objects are realized by a drawbar connection which replaces the standard draft gear with a filling means which is relatively rigid compared to a standard draft gear. This eliminates draft gear travel, which is the largest single source of horizontal movement in a standard drawbar or coupler connection. The filling means is placed in the standard draft gear pocket utilizing a standard yoke. The yoke is connected to a drawbar in the same manner as it would be connected to a conventional coupler having a "F" shank.

DETAILED DESCRIPTION OF THE INVENTION

Figure 4:
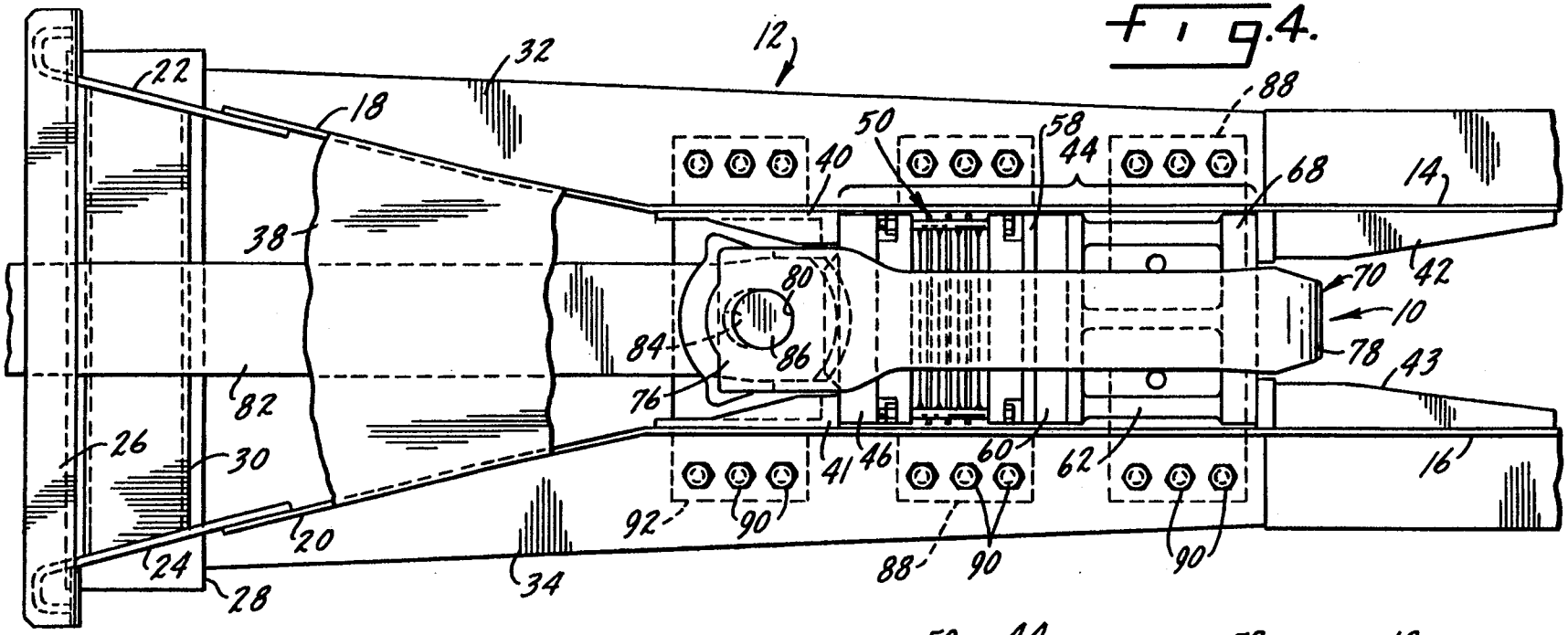
FIG. 4 is a plan view of the installed drawbar connection.
Figure 5:
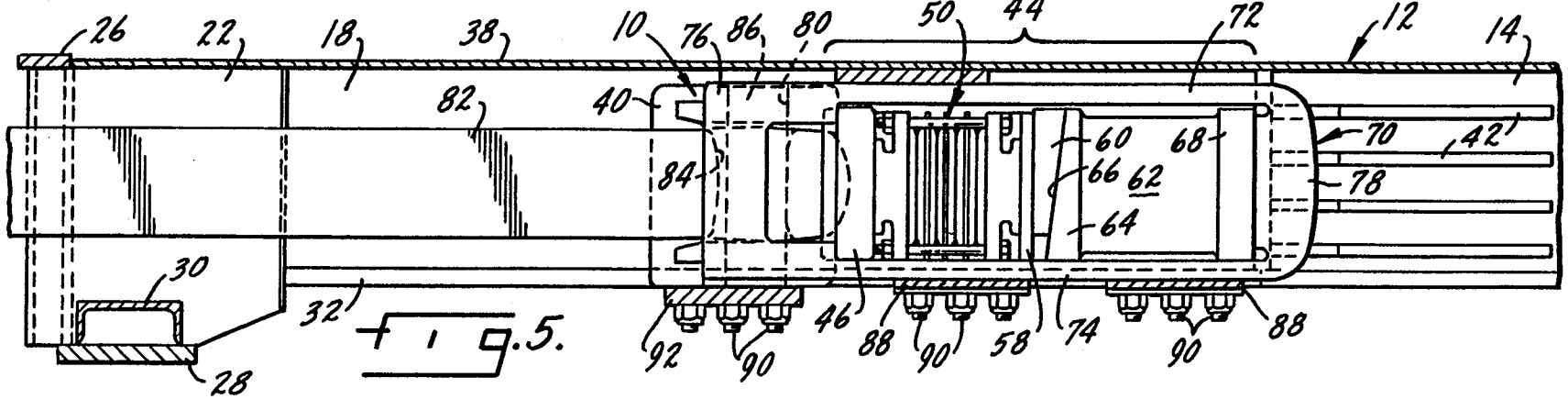
FIG. 5 is a side elevation view of the drawbar connection.

FIGS. 4 and 5 illustrate the drawbar connection 10 of the present invention. The drawbar connection 10 fits in a draft sill shown generally at 12. The draft sill is connected to the remainder of the railroad freight car in the conventional manner.

Figure 3:
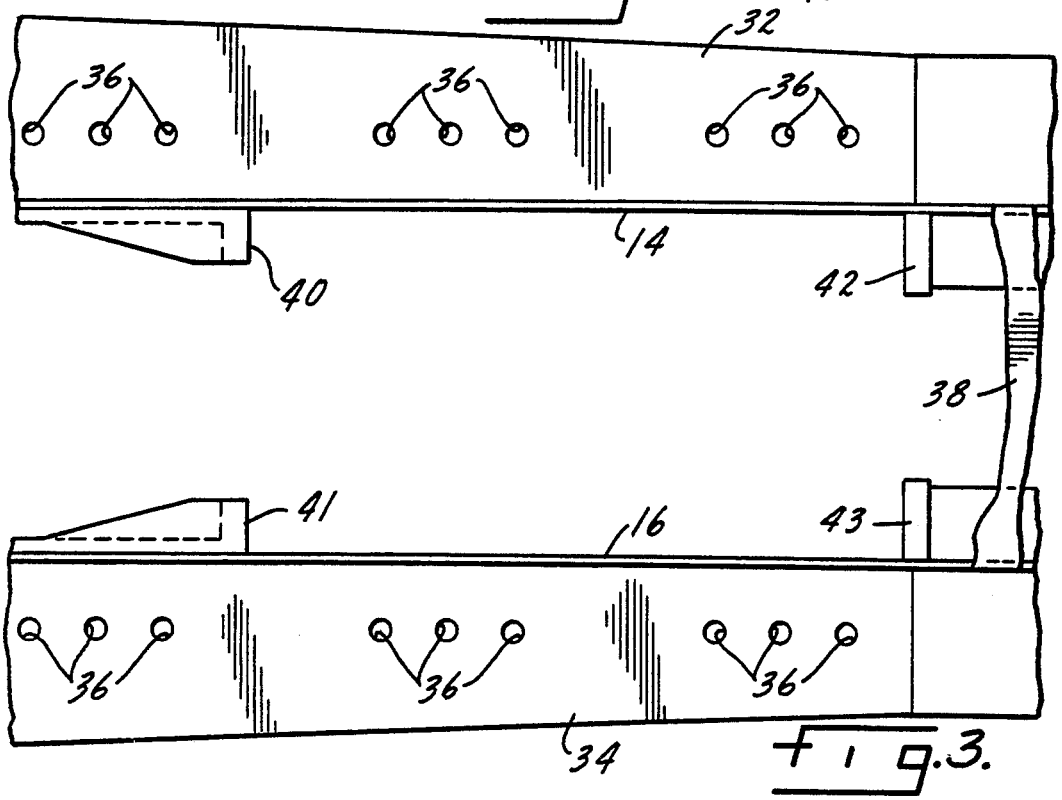
FIG. 3 is a plan view of a railroad freight car draft sill and draft gear pocket, with the cover plate removed to show the rear draft lugs.

The draft sill 12 includes vertical side walls 14 and 16 which flare out at the open ends 18 and 20. The ends 18 and 20 are connected to J-shaped plates 22 and 24. Plates 22 and 24 are connected by upper and lower lateral braces 26 and 28. A channel 30 reinforces the brace 28. Horizontal flanges 32 and 34 connect to the bottom edges of the side walls 14 and 16, respectively. These flanges have a plurality of bolt holes 36 (FIG. 3). The top edges of the side walls are connected by a cover plate 38.

As best seen in FIG. 3, pairs of front and rear draft lugs define a draft gear pocket. The front draft lugs are shown at 40 and 41 while the rear draft lugs are shown at 42 and 43. The draft lugs are attached to the side walls 14 and 16. The space between the draft lugs is referred to as the draft gear pocket. The draft pocket is located longitudinally within the draft sill at a location such that a conventional coupler, yoke and draft gear appropriate for the particular car can be applied using the draft pocket. While the illustrations show a configuration suitable for a car with long end overhang, it will be appreciated that for a car with shorter overhang, the draft pocket would be located closer to the end of the draft sill. In cases where the overhang is short enough to permit the use of Type "E" couplers using cross keys for connection to the yoke, the front draft lugs 40 and 41 would incorporate longitudinal slots to permit application of the cross key when the drawbar is replaced by individual couplers.

Figure 1:
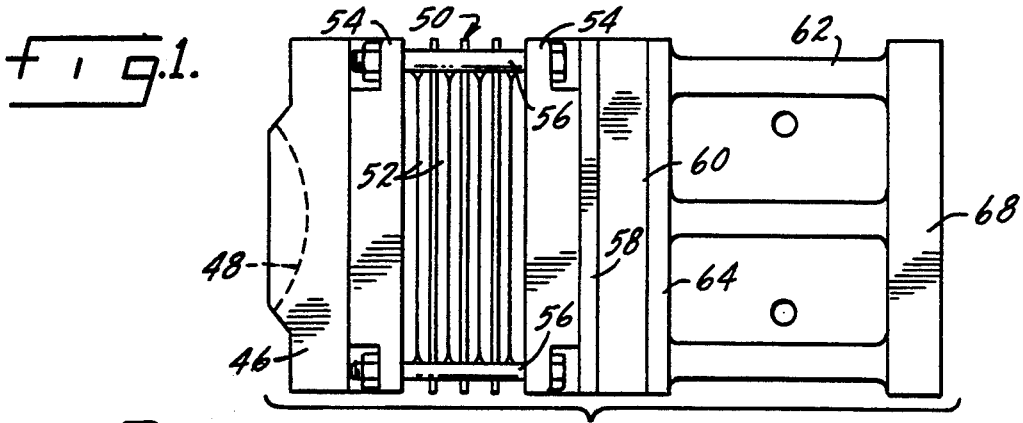
FIG. 1 is a plan view of the filling means used in the drawbar connection of the present invention.

In prior art coupler or drawbar connections utilizing a conventional draft gear pocket the draft gear pocket is filled with a draft gear. The present invention replaces the usual draft gear with a relatively rigid filling means shown generally at 44 in FIG. 1. It will be understood that the term relatively rigid is defined to mean the filling means has a travel which may range from essentially no travel to about a half inch or so. This amount of travel contrasts with the standard draft gear travel of about three and one quarter inches. Thus, the filling means of the present invention is relatively rigid compared to the standard draft gear. This reduced amount of travel is also controlled such that no travel occurs until a predetermined amount of coupler force is applied to the draft system. In the present embodiment of the invention, this predetermined coupler force is set at approximately 100,000 pounds, but it is apparent that this force level can be set to any desired value.

The filling means 44 is disposed in the draft gear pocket and extends from the front draft gear lugs 40, 41 to the rear lugs 42, 43. In this embodiment, the filling means includes a follower block 46 located at the front of the filling means. The follower block has a spherical depression 48 in its front face for receiving the rounded end of the drawbar and may be a standard Y46 follower. Next to the follower block is a mini-draft gear 50. The mini-draft gear provides controlled travel when subjected to compressive force and may consist of a series of rubber blocks 52 located between end plates 54 and compressed by bolts 56. The mini-draft gear may have a maximum travel on the order of one-half inch. That is, it may be compressed about a half an inch or so.

A spacer 58 is located adjacent the mini-draft gear 50. The spacer has a thickness, as required, to give the entire filling means 44 a length such that the wedge 60 is raised upward in the opening provided by the yoke 70. The overall length of the filling means is determined when it is assembled in the yoke and a preload of about 100,000 pounds is applied, as will be explained below.

Figure 2:
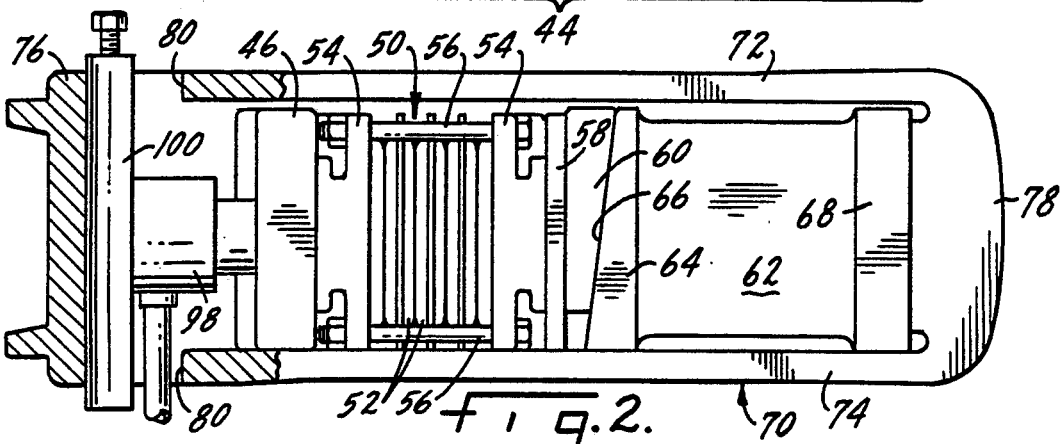
FIG. 2 is a side elevation view of the filling means installed in a yoke and compressed prior to installation in a draft gear pocket.

A wedge 60 fits next to the spacer 58. Upon initial installation of the filling means parts, the wedge is located with its upper edge at or near the upper edge of the mini-draft gear. The wedge is designed to drop down under the force of gravity, as seen in FIG. 5, to compensate for wear in the filling means components. The wedge fits between the spacer 58 and a rigid filler block 62. In this embodiment the filler block is a casting having a front wall 64 with an inclined front surface 66. The angle of the surface 66 matches that of the wedge 60, as best seen in FIG. 2. The other end of the filler block 62 has a rear wall 68. The angle of the filler block 66 and the wedge 60 has been carefully selected so as to prevent inadvertent lifting of the wedge under impact but also to provide sufficient compensation for wear of the various components in the draft pocket as the wedge drops.

The drawbar connection also has a yoke 70. Preferably, this is a standard Y-45 yoke. It has top and bottom longitudinally-extending arms 72, 74 which are connected at the front by a head portion 76 and at the rear of the yoke by a heel 78. The head has an opening disposed on a horizontal axis for receiving the drawbar. The head also has a second opening 80 (FIG. 4) on a vertical axis for receiving the coupler pin.

The drawbar itself is shown at 82 in FIGS. 4 and 5. The drawbar has an opening 84 near its end aligned with the opening 80 of the yoke. A coupler pin 86 is disposed vertically in opening 80 of the yoke and opening 84 of the drawbar to connect the drawbar and the yoke together. The portion of the drawbar which contacts the drawbar connection has the same contour as that of a conventional Type "F" coupler shank.

Once the yoke and filling means are installed in the draft sill, they are held in place by carrier plates 88 which are bolted to flanges 32, 34 by bolts 90. The bolts extend through the bolt holes 36. The filling means 44 has been designed to allow for inspection of the wedge 60 without the need to remove the carrier plates 88. Similarly, the coupler pin 86 is held by a coupler pin carrier plate 92 which is bolted to flanges 32,34. The carrier plates complete the construction of the drawbar connection. Attention will now be turned to the preferred method of installing the above-described parts.

The first step in installing the connection is to measure the draft gear pocket length between the front and rear draft lugs. That is, the distance between the lugs 40, 42 and between lugs 41, 43 is measured. The greater of these two measurements is used as the draft gear pocket length.

Next, the filling means, minus the spacer 58, is assembled in the yoke and a preload of about 100,000 pounds is applied. This preload is applied by a hydraulic ram 98 which is temporarily located within the openings of the yoke head. The ram butts up against a halved coupler pin 100 which is also temporarily located in the yoke head for purposes of installing the filling means. After applying the preload, the overall length of the filling means' components (less spacer 58) is measured. The thickness of the spacer 58 is chosen to obtain a total filling means length equal to the measured draft gear pocket length with the wedge 60 raised a maximum amount within the yoke 70. Once this dimension is obtained, the pressure of the hydraulic ram is released and a spacer 58 of the desired thickness is inserted between the mini-draft gear 50 and the wedge 60. The hydraulic ram 98 is then reapplied and the pressure is increased to compress the assembly to a length of about $\frac{1}{8}$ inch less than the draft gear pocket length.

With the filling means thus compressed, the yoke and filling means are inserted into the draft sill from the open underside, with the follower block 46 slipping in adjacent to the front draft lugs 40, 41 and the filler block 62 sliding in adjacent to the rear draft lugs 42, 43. Once the yoke and filling means are inserted into the draft gear pocket, the carrier plates 88 may be bolted in place to hold the yoke and filling means in place. At this point the pressure of the hydraulic ram 98 is released and it is removed from the yoke, along with the halved pin 100. The drawbar 82 can then be inserted into the head of the yoke, with the drawbar opening 84 aligned with the yoke vertical opening 80. The coupler pin 86 is installed, followed by the bolted pin carrier plate 92.

The end of the drawbar fits into the depression 48 of the follower block 46. Buff loads are transmitted by the drawbar through the follower block 46, mini-draft gear 50, spacer 58, wedge 60, and filler block 62 to the rear draft lugs 42, 43. Draft loads are transmitted by the coupler pin to the yoke head, arms and heel and, from there, through the filling means in the reverse order of that described above to the front draft lugs 40, 41.

The purpose of the mini-draft gear 50 is to accommodate vertical angling of the drawbar as is required when the car negotiates vertical curves in the track. The mini-draft gear may be configured with a preload so that application of a minimum amount of compressive force is required before the draft gear compresses. This preload may be set at any desired value, such as 100,000 pounds. The maximum travel of the mini-draft gear is set at a value, such as $\frac{1}{2}$-inch, that is just sufficient to permit the portion of the drawbar behind the coupler pin 86 to angle in the vertical plane without becoming bound between the coupler pin 86 and the follower block 46.

The described drawbar connection reduces slack on three levels compared to a standard coupler connection. First, replacing couplers with a drawbar removes the contour slack in the coupler heads and knuckles. Second, replacing the usual draft gear with a relatively rigid filling means and wedge eliminates draft gear travel which is the largest single source of coupler or drawbar movement. Third, the mini-draft gear permits a minimal amount of movement, just enough to prevent binding of the coupler pin. The drawbar connection can be used to connect two or more carbodies to form a complete multi-unit car. The inventors have successfully connected as many as four carbodies with the described drawbar connection.

Figure 6:
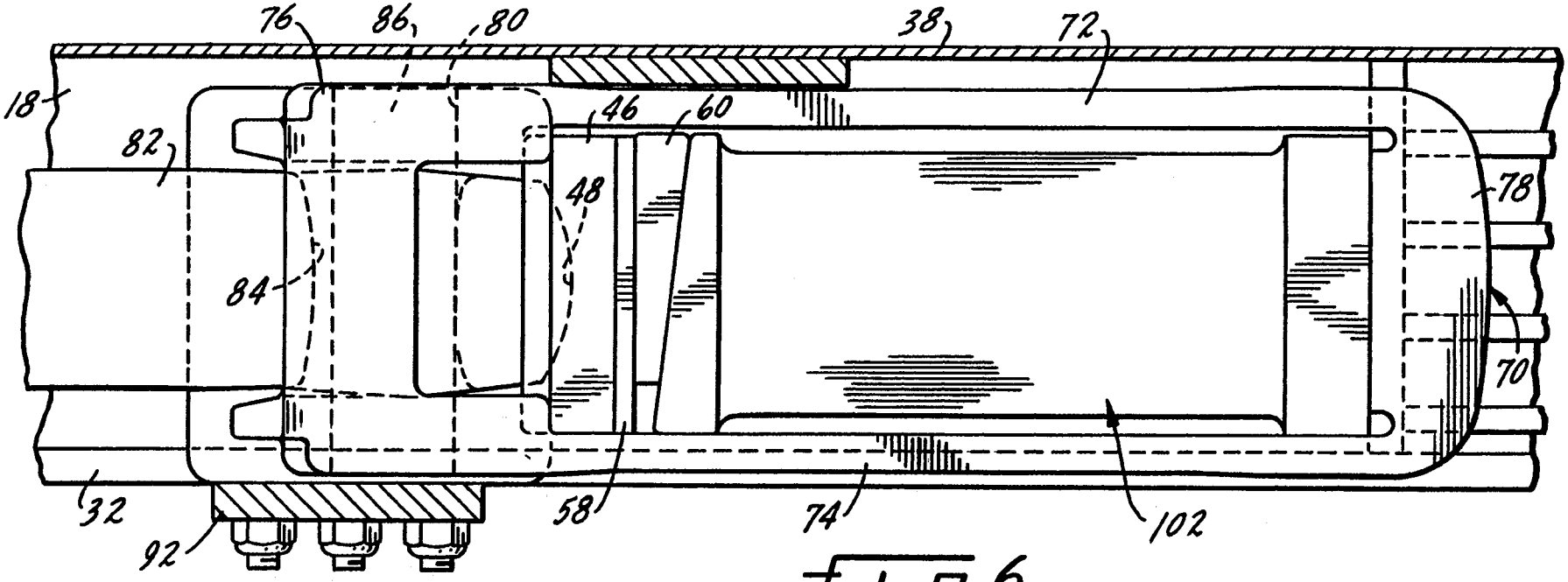
FIG. 6 is a side elevation of an alternate embodiment of the present invention.

An alternate form of the drawbar connection is shown in FIG. 6. This embodiment uses many of the same parts as the previous embodiment. Description of those parts will not be repeated. In the embodiment of FIG. 6, the mini-draft gear 50 and short filler block are replaced by a single, longer filler block 102.

When the controlled travel of the mini-draft gear is eliminated, the limited amount of slack in the connection of the yoke, coupler pin, drawbar butt and follower block is relied upon to permit vertical angling of the drawbar.

While preferred and alternate forms of the invention have been shown and described, it will be realized that modifications may be made thereto without departing from the scope of the following claims.

We claim:

1. In a railroad car of the type having a standard draft gear pocket defined by front and rear draft lugs attached to a draft sill, an improved drawbar connection, comprising:

relatively rigid filling means disposed in the draft gear pocket and extending from the front draft lugs to the rear draft lugs, the filling means being disposed so as to transmit draft loads to the front draft lugs, and having a travel of no more than about one half inch;

a yoke having first and second longitudinally-extending arms spanning the filling means, the arms being connected at one end by a head portion and at the other end by a heel, the head having first and second openings disposed on horizontal and vertical axes, respectively, the heel engaging the end of the filling means closest to the rear draft lug;

a drawbar extending through the first opening in the yoke and having a hole at one end aligned with the second opening of the yoke; and a coupler pin disposed in the hole of the drawbar and the second opening of the yoke.

2. The structure of claim 1 wherein the filling means comprises a follower block disposed in the draft gear pocket adjacent the front draft lug.

3. The structure of claim 1 wherein the filling means comprises a rigid filler block adjacent the rear draft lug.

4. The structure of claim 1 wherein the filling means comprises a mini-draft gear providing a maximum travel of about one-half inch.

5. The structure of claim 1 wherein the filling means comprises a follower block adjacent the front draft lug and a rigid filler block adjacent the rear draft lug.

6. The structure of claim 1 wherein the filling means comprises a follower block, a rigid filler block, and a mini-draft gear providing a maximum travel of about one-half inch.

7. The structure of claim 1 wherein the filling means comprises a follower block, a rigid filler block, a mini-draft gear providing a maximum travel of about one-half inch, and a wedge.

8. The structure of claim 7 wherein the follower block is adjacent the front draft lug, the rigid filler block is adjacent the rear draft lug, and the mini-draft gear and wedge are between the follower block and filler block.

9. The structure of claim 1 wherein the filling means comprises a follower block, a rigid filler block, a mini-draft gear providing a maximum travel of about one-half inch, a wedge, and a spacer having a size such that the wedge is raised to a maximum height within the yoke prior to installation, the mini-draft gear being slightly compressible to permit installation of the filling means in the gear pocket.

10. In a railroad car comprised of a plurality of carbodies of the type having standard draft gear pockets defined by front and rear draft lugs attached to a draft sill, a method of improving train handling characteristics by reducing slack between carbody units, comprising the steps of:

placing a relatively rigid filling means in the draft gear pockets of carbody units to be assembled by drawbars into multiple-unit cars, the filling means extending from draft load transmitting relation with the front draft lug to the rear draft lug and having a travel of no more than about one half inch;

surrounding the filling means with a yoke having first and second longitudinally-extending arms, the arms being connected at one end by a head portion and at the other end by a heel, the head having first and second openings disposed on horizontal and vertical axes, respectively, the heel engaging the end of the filling means closest to the rear draft lug;

placing a drawbar through the first opening in the yoke, the drawbar having a hole at one end aligned with the second opening of the yoke; and connecting the drawbar to the yoke by placing a coupler pin in the hole of the drawbar and the second opening of the yoke.

11. In a railroad car comprised of a plurality of carbodies of the type having standard draft gear pockets defined by front and rear draft lugs attached to a draft sill, a method of installing an improved drawbar connection between carbody units, comprising the steps of:

measuring the draft gear pocket length between the front and rear draft lugs;

assembling in a yoke a relatively rigid filling means;

measuring the length of the filling means and adding spacers as required to raise a wedge to a maximum height within the yoke when the length of the filling means equals the pocket length;

compressing the filling means in the yoke to a length slightly less than the pocket length;

placing the filling means in the draft gear pocket with the yoke surrounding the filling means and attaching retainer plates to hold the assembly therein;

releasing the compression on the filling means; and attaching a drawbar to the yoke by means of a coupler pin.

* * * * *